US005476554A

United States Patent [19]

Ishii et al.

[11] Patent Number: 5,476,554

[45] Date of Patent: Dec. 19, 1995

[54] FE-CR-AL ALLOY FOIL HAVING HIGH OXIDATION RESISTANCE FOR A SUBSTRATE OF A CATALYTIC CONVERTER AND METHOD OF MANUFACTURING SAME

[75] Inventors: Kazuhide Ishii; Masaaki Kohno, both of Chiba, Japan

[73] Assignee: Kawasaki Steel Corporation, Japan

[21] Appl. No.: 246,992

[22] Filed: May 20, 1994

[30] Foreign Application Priority Data

May 20, 1993 [JP] Japan ..... 5-118336
Sep. 14, 1993 [JP] Japan ..... 5-228770

[51] Int. Cl.[6] ..... C21D 9/00; C22C 38/06; C22C 38/28

[52] U.S. Cl. ..... 148/325; 148/606

[58] Field of Search ..... 420/62, 79; 148/325, 148/606

[56] References Cited

U.S. PATENT DOCUMENTS 5,228,932 7/1993 Shimizu et al. ..... 420/62

*Primary Examiner*—Deborah Yee
*Attorney, Agent, or Firm*—Austin R. Miller

[57] ABSTRACT

Fe—Cr—Al alloy foil having high oxidation resistance for a substrate catalytic converter. The alloy foil contains about: C: 0.02 wt. % or less, N: 0.02 wt. % or less, Si: 1.0 wt. % or less, Mn: 1.0 wt. % or less, Cr: from 15 to 26 wt. %, Al: from 4.5 to 8.0 wt. %, Sm: from 0.05 to 0.30 wt. %, Zr: from 0.01 to 0.10 wt. %, and Hf: 0.005 wt. % to 0.10 wt. %, the balance consisting of Fe and incidental impurities.

2 Claims, No Drawings

FE-CR-AL ALLOY FOIL HAVING HIGH OXIDATION RESISTANCE FOR A SUBSTRATE OF A CATALYTIC CONVERTER AND METHOD OF MANUFACTURING SAME

BACKGROUND OF THE INVENTION

1. Field of the Invention

The present invention relates to an Fe—Cr—Al alloy foil having high oxidation resistance at elevated temperatures, which is suitable for a substrate of a catalytic converter.

2. Description of the Related Art

Catalytic converters are used to remove harmful elements, such as $NO_x$, CO or HC, generated by burning fossil fuel. Various types of catalytic converters are used in automobiles. Of such converters, converters composed of a honeycomb-structure made from an Fe—Cr—Al alloy foil have come to be widely used, because they have many advantages, such as reducing pressure loss.

A catalytic converter made from an Fe—Cr—Al alloy foil is disclosed in, for example, U.S. Pat. No. 4,318,828. This publication proposes that Cr is 15 to 25 wt. % Al 3 to 6 wt. % and Y 0.3 to 1.0 wt. %. However, since Y is a rare metal and expensive, alloy foils containing it become very expensive, so that it is difficult to use these foils in a common automobile from an economical point of view.

On the other hand, it has been proposed in U.S. Pat. No. 4,414,023 that Cr: 8 to 25 wt. % Al: 3 to 8 wt. %, and rare-earth elements: 0.002 to 0.06 wt. % be used. In this publication, rare earth elements (in particular, Ce and La), which are cheaper than Y, are used in place of Y. Rare-earth elements are added to improve the adhesion of surface oxide to metal. It is described that these rare-earth elements should not be added in an amount in excess of 0.06 wt. % because they degrade the hot workability of alloys. This alloy is less expensive than the alloy foil of the above-described U.S. Pat. No. 4,318,828. However, it encounters a problem in that it has inferior oxidation resistance. It is a matter of course that the oxidation resistance is a more important property for a foil used in a catalytic converter.

In connection with this, when the inventors of the present invention examined in detail the influence of rare-earth elements, in particular La, Nd and Ce on the oxidation resistance and the hot workability of the alloy, they found that when about 0.05 or more wt. % of La and Nd are added, the oxidation resistance is improved to such an extent that it is comparable to alloy foils containing Y, and found that Ce should be removed as much as possible because Ce is the main factor resulting in degradation of the hot workability of alloy.

Using these results, the inventors of the present invention proposed in U.S. Pat. No. 4,904,540 an alloy to which La is added, and in U.S. Pat. No. 5,228,932, an alloy to which Nd is added. Further, it is described in U.S. Pat. No. 5,228,932 that the addition of a mixture of La and Zr improves the oxidation resistance of the foil. These alloys containing La, Nd and Zr exhibit higher oxidation resistance that are better than those of an ordinary Fe—Cr—Al alloy foil. It has come to be widely used.

However, as exhaust gas regulations have been recently tightened, there has been a demand that the catalytic converter is installed near the engine. Thus the foil is subjected to a more severe high-temperature oxidation. A foil having even better oxidation resistance of alloys is required. To further increase the oxidation resistance in the components in the above-described U.S. Pat. No. 5,228,932, it is necessary to increase the content of Al.

However, when the inventors of the present invention conducted research using usual stainless steel manufacturing facilities, it became clear that cracks occur in the edge of a hot rolled coil if the content of Al exceeds about 6 wt. % in an alloy containing both La and Zr, and with such cracks as the origin, the coil tends to be broken frequently during cold rolling, and the yield becomes low.

Similar problems arise in an alloy disclosed in Japanese Patent Laid-Open No. 3-36241 in which La, Ce, Zr and Hf are added.

We have examined the influence of alloy elements upon hot workability in more detail, and we have discovered that an alloy in which Sm is added in place of La has good hot workability, so that cracks do not occur even in the edge of coil, and that the alloy can be manufactured without problems by using the usual stainless steel manufacturing facilities. Similarly, we have thoroughly examined the oxidation resistance of the foil and have found that an addition of Sm, Hf and Zr considerably improves the oxidation resistance of an alloy foil. Further, we also have found that annealing under appropriate conditions improves the oxidation resistance of the alloy foil.

SUMMARY OF THE INVENTION

It is an object of present invention to provide an Fe—Cr—Al alloy foil for use in a substrate of catalytic converter and having good oxidation resistance. The alloy foil contains about: C: 0.02 wt. % or less, N: 0.02 wt. % or less, Si: 1.0 wt. % or less, Mn: 1.0 wt. % or less, Cr: from 15 to 26 wt. %, Al: from 4.5 to 8.0 wt. %, Sm: from 0.05 to 0.30 wt. %, Zr: from 0.01 to 0.10 wt. %, and Hf: 0.005 wt. % to 0.10 wt. %, and the balance consisting of Fe and unavoidable impurities. One or more elements selected from the group consisting of La, Ce, Pr and Nd may be present in an amount of about 0.05 wt. % or less in the alloy foil.

It is another object of present invention to provide a method of manufacturing an Fe—Cr—Al alloy foil having good oxidation resistance and ideal for use in a substrate of a catalytic converter, which method comprises the step of annealing foil after the final rolling at a temperature of about 800° C. to 1100° C. in an atmosphere which is composed of one or more gases selected from the group consisting of nitrogen gas, hydrogen gas and inert gas and contains 1 vol % or less oxygen gas.

Other objects and advantages of this invention will further become apparent from the description and examples of the invention.

The present invention provides an Fe—Cr—Al alloy foil having good oxidation resistance when used as a substrate of a catalytic converter. It can be accomplished by adding Sm, Zr and Hf in a mixed manner from among various components while retaining the formability of the alloy.

The action of each component and the reason for limiting the amount thereof in accordance with the present invention will be explained below.

C, N:

C or N in excess makes cold rolling difficult, because it decreases the toughness of the alloy. Moreover, it prevents Hf from improving the oxidation resistance of the alloy as described later. Therefore, the amount of C and N is limited to a range from about 0.02 wt. % or less. Preferably, the total amount of C and N is limited to about 0.03 wt. % or less.

Si:

Si is an element which improves oxidation resistance. However, since Si in excess of about 1.0 wt. % decreases the cold workability, the amount of Si is limited to about 1.0 wt. % or less. Preferably, it is about 0.5 wt. % or less.

Mn:

Since Mn decreases both oxidation resistance and corrosion resistance, the smaller the amount added, the better. However, by taking refining technology into consideration, Mn is limited to about 1.0 wt. % or less. Preferably, it is about 0.5 wt. % or less.

Cr:

Cr is an element which accelerates the effect of Al on oxidation resistance, and Cr itself improves oxidation resistance. When Cr is about 15 wt. % or less, necessary oxidation resistance cannot be secured, and when it exceeds about 26 wt. %, the toughness of the plate decreases, making cold rolling difficult. Therefore, Cr is limited to about 15 wt. % to 26 wt. %. Preferably, it is about 18 to 22 wt. %.

Al:

Al is an indispensable element in order to make an alloy have oxidation resistance in the present invention. The greater the content of Al is added, the greater the oxidation resistance achieved. When the content of Al is about 4.5 wt. % or less, the desired oxidation resistance cannot be secured. Preferably, it is about 6 wt. % or more. On the other hand, an addition of Al in a content more than 8.0 wt. % makes the alloy so brittle that it can not be cold rolled. Therefore, Al is limited to about 4.5 wt. % to about 8.0 wt. %.

Sm:

Sm is an indispensable element in order to improve oxidation resistance of an alloy of the present invention. Since an addition of Sm improves the adhesion of the oxide, which is formed on the surface of an alloy during high-temperature oxidation, and prevents Fe ions from being mixed in the oxide, it improves oxidation resistance. This effect is considerably greater than that by the addition of conventional rare earth elements. However, when the content of Sm is less than about 0.05 wt. %, it is difficult to secure the necessary oxidation resistance of foils in the thickness of approximately 20 to 100 μm, because the oxide is easily spalled in the thermal cycle. On the other hand, when the content of Sm exceeds about 0.30 wt. %, it is difficult to manufacture foils because of occurrence of cracks or surface defects during hot-rolling. Therefore Sm is limited to about 0.05 wt. % to 0.30 wt. %. Preferably, it is about 0.07 wt. % to 0.20 wt. %.

Hf:

Hf is an indispensable element in order to improve oxidation resistance of the alloy of the present invention. Since an addition of Hf reduces the growth rate of the oxide layer greatly, the oxidation resistance is improved.

However, if the content of Hf is less than about 0.005 wt. % its valuable effects do not appear. If Hf is added in an amount exceeding about 0.10 wt. %, no further improvement of oxidation resistance is achieved, and the amount of this inclusion increases too much to manufacture foils. Moreover since Hf itself is an extremely expensive element, Hf is limited to about 0,005 wt. % to about 0.10 wt. %. Preferably, it is about 0.01 wt. % to 0.07 wt. %.

Zr:

Zr, along with Sm and Hf, is an indispensable element for improving the oxidation resistance of an alloy in the present invention. The oxidation resistance is greatly improved by Hf, as already described. However, Hf easily combines with C and N in the alloy, and the Hf combined with these elements does not contribute to the improvement of oxidation resistance. Therefore, the content of C and N must be reduced as much as possible. However, it cannot be removed completely by existing steel production technology.

On the other hand, if Zr is added, C and N preferentially combine with Zr thereby, reducing the amount of Hf which combines with C and N. Accordingly, it has been discovered that mixed addition of Zr and Hf achieves very excellent oxidation resistance, much better than when only Hf is added.

However, if the content of Zr is less than about 0.01 wt. %, an effect on oxidation resistance does not appear If, on the other hand, Zr is added in an amount exceeding about 0.10 wt. %, conversely, the oxidation rate becomes higher and the oxidation resistance is decreased. Therefore, Zr is limited to about 0.01 wt. % to 0.10 wt. %. Preferably, it is about 0.02 wt. % to 0.07 wt. %.

La, Ce, Pr, Nd:

Although Sm is an expensive element, a portion of Sm added combines with P and S within the alloy and does not contribute to the improvement of oxidation resistance. In the case that Sm is added together with one or more elements selected from the group consisting of La, Ce, Pr and Nd, the amount of Sm which is combined with P and S is reduced because portions of P and S are combined with La, Ce, Pr and Nd. Therefore Sm contributes to improved oxidation resistance more effectively by addition of La, Ce, Pr and Nd. La, Pr and Nd improve oxidation resistance of alloys similarly to Sm, although the effect of these elements is smaller than that of Sm.

Therefore, by adding these elements, a foil having excellent oxidation resistance can be obtained.

However, the hot-workability and toughness of alloys are decreased by increasing the content of these elements. The diminishing of hot-workability causes cracks or surface defects on the alloy, and the low toughness makes cold-rolling difficult. As a result, it is difficult to manufacture the foil economically. Therefore, these elements are limited to about 0.05 wt. % or less. When these elements are added and Sm is present in an amount exceeding about 0.20 wt. %, cracks in the edge and surface defects are likely to occur during hot rolling. Therefore, the range of the content of La, Pr and Nd is preferably limited to about 0.20 wt. % or less.

The thickness of the foil is from about 20 μm to 100 μm. Using thinner foil has many advantages as follows. The loss of engine output is decreased and the mileage is increased by reducing the pressure loss caused by a catalytic converter. Moreover, the catalyst becomes active in a shorter time after the engine is started, because the heat capacity of the catalytic converter becomes smaller. It is a matter of course that the converter can be made in lighter weight. To obtain these advantages, it is preferable that the thickness of the foil be about 100 μm or less. However, the oxidation resistance of the foil is decreased by decreasing the thickness. When the thickness is less than about 20 μm, necessary oxidation resistance cannot be secured even by use of the alloy of the present invention. Furthermore, when the foil is thinner its strength becomes lower, so that the catalytic converter is likely to deform during use. Also, cold rolling becomes difficult. Therefore, the thickness of the foil is preferably about 20 μm or more.

Next, a method of manufacturing an alloy foil in accordance with the present invention will be explained.

When we conducted detailed research on the relationship between the conditions under which an Fe—Cr—Al alloy foil is manufactured and the resulting oxidation resistance, we discovered that the oxidation resistance of the foil is improved considerably by final annealing under proper conditions. That is, when annealing is performed in a low-oxygen atmosphere, a thin oxide film with high oxidation resistance is formed on the surface. Therefore, the oxidation rate is considerably lower during high-temperature oxidation, and excellent oxidation resistance is exhibited.

One reason why the annealing conditions should be controlled will be explained below.

Atmospheric gas:

For an atmospheric gas for annealing in a low-oxygen atmosphere, one or more gases selected from hydrogen, which is a reducing gas, and nitrogen and inert gas, which are non-oxidizing gases, are used. In this case, gas mixed with hydrogen gas makes it possible to easily lower the concentration of oxygen, so it is preferable. If AlN is formed on the foil surface, the oxidation resistance of the foil is decreased. Therefore, it is preferable that the dew point of the atmosphere be higher than about −60° C. in the atmosphere containing nitrogen.

Oxygen:

When oxygen in an annealing atmosphere exceeds about 1 vol %, the concentration of Cr and Fe within the oxide made during annealing increases, and the oxidation resistance is not improved. Therefore, oxygen is limited to about 1 vol % or less.

Annealing temperature:

When the temperature is less than about 800° C., the oxide is too thin to improve the oxidation resistance of foils. When the temperature exceeds about 1,100° C., annealing cannot be performed by conventional facilities, because the strength of the alloy of the present invention is considerably low at elevated temperatures. Therefore, the temperature is limited to about 800° C. to 1,100° C.

Regarding annealing time, annealing may be performed for about one second at 800° C. or above. If it is performed for a time exceeding about one hour the oxide becomes too thick and working gear tends to become worn during corrugation processing of the catalytic converter, making it necessary to frequently replace the gear.

DESCRIPTION OF PREFERRED EMBODIMENTS

Examples of the present invention will be explained below.

EXAMPLE 1

A workpiece was prepared by a vacuum melting furnace with a capacity of 10 kg. The chemical composition of the example of the present invention is shown in Table 1, and that of a comparative example is shown in Table 2.

The obtained alloy ingot was heated at 1,200° C. and hot rolled to a thickness of 3 mm. In B1 having a high content of Sm of 0.35 wt. % and B2 having a high content of Nd of 0,075 wt. % in the comparative example, the ingots broke up during hot-rolling and could not be rolled to 3 mm. In B3 and B4 in the comparative example in which the content of Al was 6 wt. % or more and La was present in excess of 0.05 wt. %, large cracks in the edges were generated, so subsequent tests were not conducted.

Further, after descaling, cold rolling was performed. The plate cracked during cold rolling in B5 with a high content of C of 0,022 wt. %, in B6 with a high content of Si of 1.46 wt. %, in B7 with a high content of Cr of 27.1 wt. %, and in B8 with a high content of Al of 8.6 wt. % in the comparative example.

Other alloys were repeatedly cold rolled and annealed, and formed into a foil with a thickness of 50 μm.

Although six (6) wt. % or more of Al was present fin this example except for A2 and A7, cracks were observed even in edges of these hot rolled plates, and all samples were cold rolled without cracks. It is clear that the alloy foil of the present invention has excellent formability.

A test piece, 20 mm wide and 30 mm long, was made from these foils, and an oxidation test was carried out at 1,200° C. in atmospheric air. For the oxidation test, a method was used in which the test piece was taken out every 24 hours and a change of weight was measured and the outward appearance of the test piece was observed. An evaluation was made in such a way that the time obtained by subtracting 24 hours from the time when break-away oxidation occurred in the test piece was used as the oxidation life of the foil. The break-away oxidation is a rapid oxidation which occurs after the oxidation resistance of the workpiece disappears.

Although a protective oxide layer is gray or green in this alloy foil, a black oxide is formed in break-away oxidation. When a black oxide is formed in an area of 25 $mm^2$ or more in this test, it is determined that break-away oxidation has occurred. Since this black oxide is very brittle and penetrates along the foil thickness, the converter itself is destroyed when such oxidation occurs. Therefore, it is reasonable to use the duration until the occurrence of break-away oxidation as the oxidation life of the foil.

Tables 1 and 2 show the oxidation life of each alloy foil. It should be noted that the longest oxidation life of the comparative example was 264 hours, whereas that of this example was 312 hours or more, in particular, an alloy foil having a content of Al of 6 wt. % or more exhibits excellent oxidation-resistance characteristics of 432 hours or more.

It is clear that the alloy foil of the present invention has no difficulty in producing excellent oxidation resistance.

Explanation of Tables 1 and 2 Hot workability When hot rolling was performed after heating at 1,200° C.

o: no cracks of a length of 5 mm or more in the edge of a plate, or no surface defects were present in the hot rolled plate.

x: alloy ingot broke up during hot rolling and no plate could not be produced, or cracks of a length of 5 mm or more in the edge of a plate, or surface defects were present in the hot rolled plate.

Cold rolling ○: no cracks of a length of 10 mm or more occurred during cold rolling.

x: a plate was cracked during cold rolling and cold rolling was stopped, or cracks of a length of 10 mm or more occurred in the cold rolled plate.

Oxidation life 24 hours is subtracted from the time when break-away oxidation occurred during an oxidation test conducted at 1,200° C.

TABLE 1

| | | | | | | | Examples | | | | | |
|---|---|---|---|---|---|---|---|---|---|---|---|---|
| No | C | Si | Mn | Cr | Al | N | REM | Hf | Zr | Hot working | Cold working | Oxidation Life (h) |
| A 1 | 0.005 | 0.12 | 0.21 | 20.4 | 6.3 | 0.008 | Sm/0.071 | 0.010 | 0.035 | o | o | 456 |
| A 2 | 0.006 | 0.25 | 0.35 | 19.8 | 4.8 | 0.010 | Sm/0.095 | 0.012 | 0.053 | o | o | 336 |
| A 3 | 0.004 | 0.08 | 0.10 | 24.7 | 7.2 | 0.006 | Sm/0.103 | 0.062 | 0.033 | o | o | >960 |
| A 4 | 0.003 | 0.13 | 0.15 | 25.2 | 7.1 | 0.007 | Sm/0.072<br>Ce/0.013<br>La/0.006<br>Nd/0.002<br>Pr/0.001 | 0.027 | 0.044 | o | o | >960 |
| A 5 | 0.006 | 0.22 | 0.18 | 16.8 | 6.6 | 0.008 | Sm/0.162 | 0.041 | 0.088 | o | o | 432 |
| A 6 | 0.007 | 0.18 | 0.15 | 16.3 | 6.4 | 0.011 | Sm/0.099<br>La/0.024 | 0.021 | 0.051 | o | o | 384 |
| A 7 | 0.008 | 0.14 | 0.12 | 16.3 | 5.2 | 0.007 | Sm/0.204 | 0.019 | 0.047 | o | o | 312 |
| A 8 | 0.008 | 0.20 | 0.25 | 19.9 | 6.1 | 0.009 | Sm/0.063<br>La/0.015<br>Nd/0.021<br>Pr/0.005 | 0.020 | 0.043 | o | o | 480 |
| A 9 | 0.004 | 0.11 | 0.28 | 19.1 | 6.0 | 0.005 | Sm/0.078<br>Nd/0.019 | 0.009 | 0.039 | o | o | 456 |
| A 10 | 0.006 | 0.25 | 0.23 | 21.5 | 6.2 | 0.013 | Sm/0.075<br>Pr/0.031 | 0.015 | 0.041 | o | o | 504 |
| A 11 | 0.012 | 0.32 | 0.25 | 18.7 | 6.6 | 0.008 | Sm/0.149 | 0.017 | 0.028 | o | o | 480 |

TABLE 2

| | | | | | | | Comparative Examples | | | | | |
|---|---|---|---|---|---|---|---|---|---|---|---|---|
| No | C | Si | Mn | Cr | Al | N | REM | Hf | Zr | Hot working | Cold working | Oxidation Life (h) |
| B 1 | 0.005 | 0.10 | 0.18 | 20.2 | 5.2 | 0.008 | Sm/0.35 | 0.011 | 0.024 | x | — | — |
| B 2 | 0.006 | 0.32 | 0.37 | 20.2 | 5.1 | 0.008 | Sm/0.105<br>Nd/0.075 | 0.012 | 0.064 | x | — | — |
| B 3 | 0.005 | 0.09 | 0.11 | 20.3 | 6.7 | 0.006 | La/0.082 | — | 0.032 | x | — | — |
| B 4 | 0.008 | 0.24 | 0.28 | 19.7 | 6.4 | 0.007 | La/0.104<br>Ce/0.021 | 0.084 | 0.035 | x | — | — |
| B 5 | 0.022 | 0.14 | 0.15 | 19.9 | 5.1 | 0.019 | Sm/0.085 | 0.015 | 0.051 | o | x | — |
| B 6 | 0.006 | 1.46 | 0.36 | 20.7 | 5.0 | 0.009 | Sm/0.099 | 0.014 | 0.121 | o | x | — |
| B 7 | 0.009 | 0.41 | 0.52 | 27.1 | 5.4 | 0.006 | Sm/0.073 | 0.015 | 0.044 | o | x | — |
| B 8 | 0.003 | 0.08 | 0.07 | 20.2 | 8.6 | 0.004 | Sm/0.091 | 0.047 | 0.052 | o | x | — |
| B 9 | 0.005 | 0.10 | 0.14 | 13.9 | 5.4 | 0.007 | Sm/0.068<br>Nd/0.021 | 0.012 | 0.081 | o | o | 120 |
| B 10 | 0.012 | 0.11 | 0.14 | 20.5 | 4.2 | 0.010 | Sm/0.108 | 0.021 | 0.015 | o | o | 96 |
| B 11 | 0.006 | 0.42 | 0.37 | 20.1 | 5.3 | 0.009 | Sm/0.032 | 0.012 | 0.010 | o | o | 96 |
| B 12 | 0.004 | 0.12 | 0.18 | 19.5 | 5.1 | 0.007 | La/0.085 | — | 0.042 | o | o | 240 |
| B 13 | 0.006 | 0.22 | 0.20 | 19.8 | 4.9 | 0.006 | Sm/0.072 | 0.001 | 0.003 | o | o | 216 |
| B 14 | 0.005 | 0.21 | 0.18 | 19.7 | 5.3 | 0.008 | Sm/0.068 | — | 0.187 | o | o | 192 |
| B 15 | 0.006 | 0.12 | 0.14 | 19.7 | 5.4 | 0.006 | Sm/0.102 | 0.006 | 0.28 | o | o | 72 |
| B 16 | 0.004 | 0.17 | 0.12 | 20.2 | 5.0 | 0.006 | Sm/0.078 | 0.015 | — | o | o | 264 |

EXAMPLE 2

An oxidation test was conducted on the alloy foils of A1 and A5 in the first embodiment, which alloy foils were annealed under the conditions shown in Table 3. The oxidation resistance of these samples was evaluated in the same way as in Example 1 and are shown in Table 3. The oxidation lives of Comparative Example 1, in which the annealing temperature was as low as 750° C., Comparative Example 2, in which the alloy foil was annealed in an atmosphere containing 1.5% oxygen, and Comparative Example 3, in which the alloy foil was annealed in atmospheric air were not much different from the oxidation life of the foil as rolled in Example 1. In contrast, the oxidation life of this example was considerably longer than that of the foil as rolled in Example 1. It is clear that the annealing method of the present invention was effective for improving oxidation resistance.

As the results of the above-described experiments show, the alloy foil of the present invention has oxidation resistance that is considerably better than those of the Fe—Cr—Al alloy foil of the prior art. The alloy foil of this invention is suitable for use in a catalytic converter of an automobile, which requires oxidation resistance, in particular, for a material installed near the exhaust manifold of an engine in which the conventional alloy foil cannot be used due to lacking in the oxidation resistance. Thus, the alloy foil will contribute to prevent air pollution caused by automobiles. The alloy foil of the present invention is useful for other applications in which metals are subjected to severe oxidation.

Many different embodiments of the present invention may be constructed without departing from the spirit and scope of the present invention. It should be understood that the present invention is not limited to the specific embodiments described in this specification. To the contrary, the present invention is intended to cover various modifications and equivalent arrangements included within the spirit and scope of the claims. The following claims are to be accorded the broadest interpretation, so as to encompass all such modifications and equivalent structures and functions.

TABLE 3

| | Alloy Foil | Annealing Temperature | Oxygen Concentration | Atmosphere | Oxidation Life (hour) |
|---|---|---|---|---|---|
| Example 1 | A 1 | 800° C. | <0.1 vol % | 25% $N_2$ + 75% Ar | 624 |
| Example 2 | A 1 | 950° C. | <0.1 vol % | 25% $N_2$ + 75% $H_2$ | >960 |
| Example 3 | A 1 | 950° C. | <0.1 vol % | $H_2$ | >960 |
| Example 4 | A 1 | 950° C. | 0.1 vol % | Ar | 696 |
| Example 5 | A 5 | 950° C. | <0.1 vol % | $H_2$ | 792 |
| Comparative Example 1 | A 1 | 750° C. | <0.1 vol % | 25% $N_2$ + 75% $H_2$ | 456 |
| Comparative Example 2 | A 1 | 950° C. | 1.5 vol % | Ar | 336 |
| Comparative Example 3 | A 5 | 950° C. | 2.1 vol % | Air | 456 |

What is claimed is:

1. A method of manufacturing an Fe—Cr—Al alloy foil having high oxidation resistance for a substrate of a catalytic converter, said method comprising the step of: annealing said foil at a temperature from about 800° C. to 1,100° C. in an atmosphere containing about 1 vol % or less of oxygen in one or more gases selected from the group consisting of nitrogen, hydrogen and inert gas, and forming a thin oxide film on said foil, said annealing step being conducted after final rolling to a foil.

2. An Fe—Cr—Al alloy foil having high oxidation resistance comprising a substrate containing about: C: 0.02 wt. % or less, N: 0.02 wt. % or less, Si: 1.0 wt. % or less, Mn: 1.0 wt. % or less, Cr: from 15 to 26 wt. %, Al: from 4.5 to 8.0 wt. %, Sm: from 0.05 to 0.30 wt. %, Zr: from 0.01 to 0.10 wt. %, and Hf: 0.005 wt. % to 0.10 wt. %, and the balance Fe and incidental impurities; and a thin oxide film formed on said substrate.

* * * * *